US005100517A

United States Patent [19]

Starinshak et al.

[11] Patent Number: 5,100,517

[45] Date of Patent: Mar. 31, 1992

[54] PROCESS FOR APPLYING A COPPER LAYER TO STEEL WIRE

[75] Inventors: Thomas W. Starinshak, Wadsworth; Gary P. Wood, Fairlawn, both of Ohio

[73] Assignee: The Goodyear Tire & Rubber Company, Akron, Ohio

[21] Appl. No.: 681,266

[22] Filed: Apr. 8, 1991

[51] Int. Cl.[5] ..... C25D 3/38; C25D 7/06

[52] U.S. Cl. ..... 205/138; 205/292; 205/295

[58] Field of Search ..... 204/27, 52.1

[56] References Cited

U.S. PATENT DOCUMENTS 4,545,834 10/1985 Shemenski ..... 204/40

*Primary Examiner*—T. M. Tufariello

*Attorney, Agent, or Firm*—Alvin T. Rockhill

[57] ABSTRACT

Copper plating cells which utilize soluble copper anodes which replenish the electrolyte with copper ions are normally used for applying copper layers to steel filaments. The amount of copper in such soluble anodes is diminished throughout the plating procedure and ultimately such soluble copper anodes need to be replaced. It has been discovered that insoluble anodes can be utilized in such plating cells. Such a process for applying a copper layer to a steel filament comprises: (a) applying a negative charge to the steel filament which is in contact with an aqueous copper pyrophosphate solution, wherein the aqueous copper pyrophosphate solution is in contact with a positively charged inert anode; (b) allowing copper ions from the copper pyrophosphate solution to be reduced on the steel filament to form the copper layer; and (c) replenishing the concentration of copper ions in the copper pyrophosphate solution by applying a positive charge to a copper anode which is in contact with the copper pyrophosphate solution and applying a negative charge to a cathode which is in contact with a potassium hydroxide solution, wherein the copper pyrophosphate solution and the potassium hydroxide solution are separated by a conductive membrane which allows electrical current and potassium ions to flow through it without allowing copper ions or pyrophosphate ions to diffuse through it.

15 Claims, 1 Drawing Sheet

PROCESS FOR APPLYING A COPPER LAYER TO STEEL WIRE

BACKGROUND OF THE INVENTION

It is frequently desirable to reinforce rubber articles, for example, tires, conveyor belts, power transmission belts, timing belts, hoses, and the like products, by incorporating therein steel reinforcing elements. Pneumatic vehicle tires are often reinforced with cords prepared from brass coated steel filaments. Such tire cords are frequently composed of high carbon steel or high carbon steel coated with a thin layer of brass. Such a tire cord can be a monofilament, but normally is prepared from several filaments which are stranded together. In most instances, depending upon the type of tire being reinforced, the strands of filaments are further cabled to form the tire cord.

In order for rubber articles which are reinforced with steel wire elements to function effectively it is imperative that good adhesion between the rubber and the steel cord be maintained. Thus, generally steel wire reinforcement elements are coated with brass in order to facilitate rubber-metal adhesion.

It is generally agreed by those skilled in the art that adhesion of rubber to brass-plated steel wire is dependent upon a bond between the copper in the brass and sulfur in the rubber. When such brass coated steel reinforcing elements are present in the rubber composition during vulcanization, it is believed that bonds between the rubber and steel reinforcement gradually form due to a chemical reaction between the brass alloy and the rubber at the interface forming a bonding layer. The brass coating also serves an important function as a lubricant during final wet drawing of steel filaments.

Over the years various techniques have been employed for coating steel filaments with brass. For instance, alloy plating has been used to plate steel filaments with brass coatings. Such alloy plating procedures involve the electrodeposition of copper and zinc simultaneously to form a homogeneous brass alloy insitu from a plating solution containing chemically complexing species. This codeposition occurs because the complexing electrolyte provides a cathodic film in which the individual copper and zinc deposition potentials are virtually identical. Alloy plating is typically used to apply alpha-brass coatings containing about 70% copper and 30% zinc. Such coatings provide excellent draw performance and good initial adhesion. However, research in recent years has shown that long-term adhesion during the surface life of a tire depends on more than bulk coating chemistry. More specifically, the nature of the service oxide layer and the chemistry variation (gradient) across the total brass coating have proven to be important.

Sequential plating is a practical technique for applying brass alloys to steel filaments. In such a procedure a copper layer and a zinc layer are sequentially plated onto the steel filament by electrodeposition followed by a thermal diffusion step. For sequential brass plating, copper pyrophosphate and acid zinc sulfate plating solutions are usually employed. Iron-brass coatings can also be applied by sequential plating. Such a procedure for applying iron-brass to steel filaments and the benefits associated therewith are described in U.S. Pat. No. 4,446,198.

In the standard procedure for plating brass on to steel filaments, the steel filament is first optionally rinsed in hot water at a temperature of greater than about 60° C. The steel filament is then acid pickled in sulfuric acid or hydrochloric acid to remove oxide from the surface. After a water rinse, the filament is coated with copper in a copper pyrophosphate plating solution. The filament is given a negative charge so as to act as a cathode in the plating cell. Copper plates are utilized as the anode. Oxidation of the soluble copper anodes replenishes the electrolyte with copper ions. The copper ions are, of course, reduced at the surface of the steel filament cathode to the metallic state.

The copper plated steel filament is then rinsed and plated with zinc in a zinc plating cell. The copper plated filament is given a negative charge to act as the cathode in the zinc plating cell. A solution of acid zinc sulfate is in the zinc plating cell which is equipped with a soluble zinc anode. During the zinc plating operation, the soluble zinc anode is oxidized to replenish the electrolyte with zinc ions. The zinc ions are reduced at the surface of the copper coated steel filament which acts as a cathode to provide a zinc layer thereon. The acid zinc sulfate bath can also utilize insoluble anodes when accompanied with a suitable zinc ion replenishment system. The filament is then rinsed and heated to a temperature of greater than about 450° C. and preferably within the range of about 500° C. to 550° C. to permit the copper and zinc layers to diffuse thereby forming a brass coating. This is generally accomplished by induction or resistance heating. The filament is then cooled and washed in a dilute phosphoric acid bath at room temperature to remove oxide. The brass coated filament is then rinsed and air dried at a temperature of about 75° C. to about 150° C.

SUMMARY OF THE INVENTION

Standard copper plating cells utilized soluble copper anodes which replenish the electrolyte with copper ions. The amount of copper in such soluble anodes is diminished throughout the plating procedure. Ultimately, it becomes necessary to replace the soluble copper anode. This is an avoidable consequence of such procedures because the anode is the source of copper for plating onto the steel filament. Nevertheless, changing the soluble copper anode results in a significant amount of "down-time" in commercial operations. A significant quantity of copper from the anodes being replaced is relegated to scrap which is wasteful.

In practicing the process of the subject invention, an insoluble anode is utilized in the plating cell. This eliminates the need for replacing soluble copper anodes. This totally eliminates the down-time associated with changing soluble copper anodes in the plating cell. It also eliminates the scrap copper from old anodes which had been replaced. Practicing the subject invention also improves plating uniformity in a multi-wire line because there is a constant anode surface area.

The subject invention more specifically discloses a process for applying a copper layer to a steel filament which comprises:

(a) applying a negative charge to the steel filament and continuously passing the steel filament through a plating cell wherein the negatively charged steel filament is in contact with an aqueous copper pyrophosphate solution and wherein the aqueous copper pyrophosphate solution is in contact with a positively charged inert anode:

(b) providing the negatively charged steel filament with sufficient residence time in the pyrophosphate solution to plate the steel filament with the copper layer of the desired thickness:

(c) replenishing the concentration of copper in the copper pyrophosphate solution in the plating cell by circulating the copper pyrophosphate solution in the plating cell with copper ion replenished copper pyrophosphate solution from a replenishment cell, wherein the replenished copper pyrophosphate solution in the replenishment cell is in contact with at least one copper anode having a positive charge, wherein the replenished copper pyrophosphate solution is in contact with a conductive membrane such as a copolymer of tetrafluoroethylene and perfluoro-3,5-dioxa-4-methyl-7-octenesulfonic acid which separates the replenished copper pyrophosphate solution from a potassium hydroxide solution, wherein the potassium hydroxide solution is in contact with a negatively charged cathode:

(d) transferring a sufficient amount of the potassium hydroxide solution which is in contact with the negatively charged cathode which produces hydroxide ions to the copper pyrophosphate solution to replenish the hydroxide ions in the copper pyrophosphate solution which are consumed at the inert anode in the copper pyrophosphate solution in the plating cell: and (e) adding a sufficient amount of water to the potassium hydroxide solution to replace the potassium hydroxide transferred to the copper pyrophosphate solution and water lost through reduction and evaporation.

DETAILED DESCRIPTION OF THE INVENTION

Figure 1:
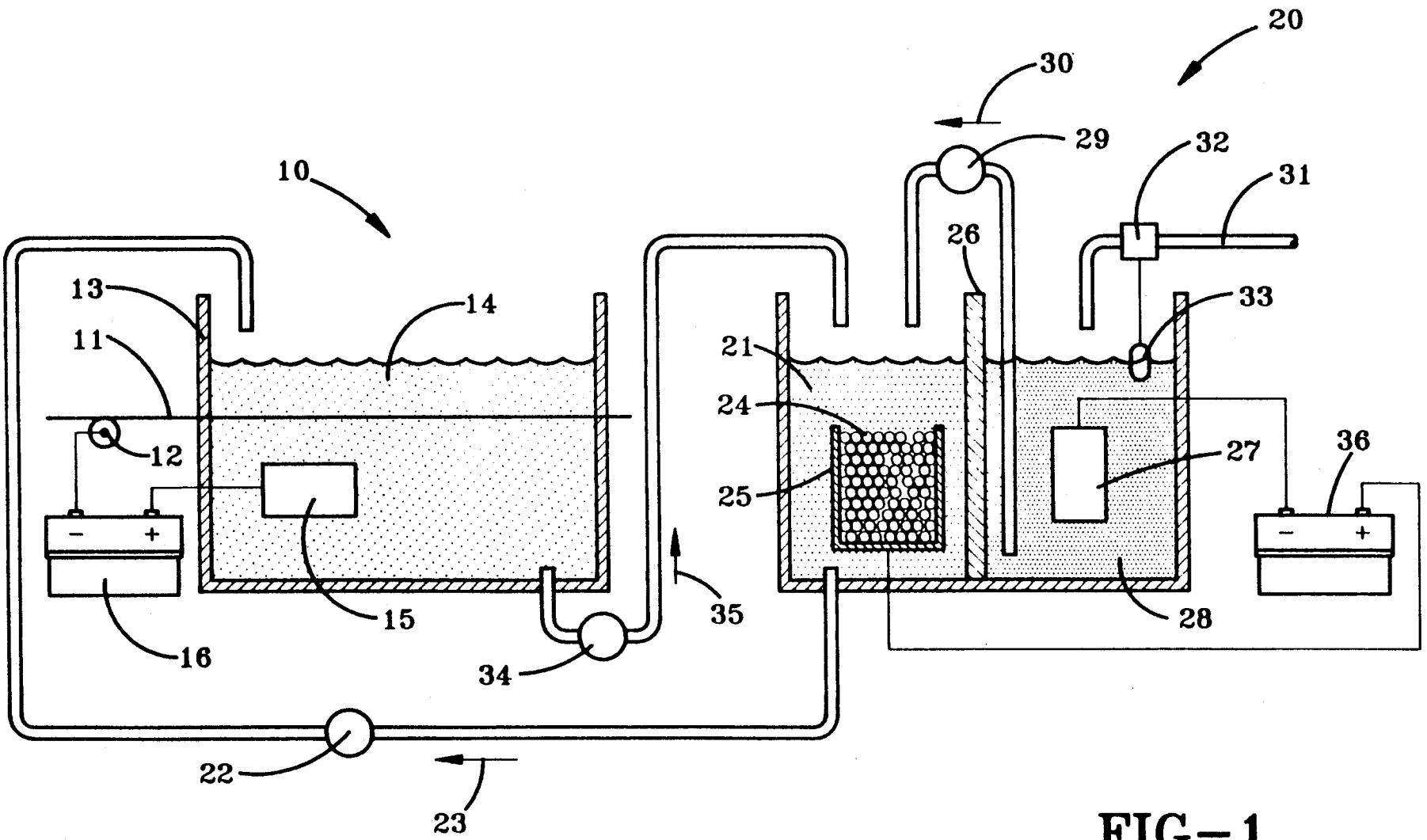
FIG. 1 is a prospective, fragmentary, and diagramic view of the apparatus of this invention including the plating cell and the replenishment cell.

By practicing the process of this invention, copper layers can be applied to steel filaments. The term "filaments" as used herein is meant to include cord, cable, strand, and wire as well as filaments. Thus, steel filaments, steel cords, steel cables, steel strands and steel wires can be coated by utilizing the technique of this invention. The process of this invention is, of course, also applicable to coating other types of platable articles with copper from a copper pyrophosphate solution.

The term "steel" as used in the present specification and claims refers to what is commonly known as carbon steel, which is also called high-carbon steel, ordinary steel, straight carbon steel, and plain carbon steel. An example of such a steel is American Iron and Steel Institute Grade 1070-high carbon steel (AISI 1070). Such steel owes its properties chiefly to the presence of carbon without substantial amounts of other alloying elements. U.S. Pat. No. 4,960,473 discloses some preferred steel alloys and an excellent process for manufacturing steel filaments which can be utilized in this invention. Brass is an alloy of copper and zinc which can contain other metals in varying lesser amounts. Alpha-brass which contains from about 60% to about 90% copper and from about 10% to about 40% zinc is generally used in coating filaments for reinforcing rubber articles. It is normally preferred for the brass to contain from about 62% to about 75% by weight copper and from about 25% to about 38% by weight zinc. Iron-brass alloys which contain 0.1 to 10 percent iron can also be employed. U.S. Pat. No. 4,446,198 discloses such iron-brass alloys and the benefits associated with using them to reinforce rubber articles, such as tires.

In practicing this invention, the steel filament is coated with a copper layer in a plating cell 10. A negative charge is applied to steel filament 11 as it is continuously passed through the plating cell. This negative charge can be applied to the steel filament by a negatively charged pulley 12 which is contact with steel filament 11. The plating cell walls 13 are typically comprised of a water impermeable plastic material, such as high density polyethylene or polypropylene. The steel filament 11 is in contact with an aqueous copper pyrophosphate solution 14 as it passes through the plating cell. The aqueous copper pyrophosphate solution 14 in the plating cell is also in contact with a positively charged inert anode 15. The inert anode 15 can be comprised of any material which will not be oxidized as a result of the plating procedure. Iridium oxide coated titanium electrodes, platinized titanium electrodes, and titanium suboxide (TiOx) electrodes (which are sold under the tradename Ebonex®) have proven to be a good choice for use as the inert anode 15. The inert anode can be comprised of any of the platinum metals, such as ruthenium, osmium, rhodium, iridium, palladium and platinum. The inert anode can also be comprised of an oxide of one or more of the platinum metals. The inert anode can also be a platinum metal oxide coated titanium electrode. The negatively charged pulley 12 and the positively charged inert anode 15 are charged from a direct current (DC) power source 16.

The copper pyrophosphate solution 14 in the plating cell will typically have a copper ($Cu^{2+}$) ion concentration of 22 to 38 grams/liter. The copper pyrophosphate solution will also typically have a pyrophosphate ($P_2O_7$) ion concentration of 159 to 250 g/liter and will have a pyrophosphate ion to copper ion ratio which is within the range of about 6.5 to about 8. The pH of the pyrophosphate solution will be maintained within the range of 8.0 to about 9.3. It is preferred for the copper pyrophosphate solution to have a pH which is within the range of about 8.3 to about 8.7. The temperature of the copper pyrophosphate solution 14 in the plating cell will be maintained within the range of about 40° C. to 60° C. It is normally preferred for the temperature of copper pyrophosphate solution 14 in the plating cell to be maintained within the range of about 45° C. to 55° C. with temperatures within the range of about 48° C. to about 52° C. being most preferred. It is normally desirable to adjust the power source 16 so as to maintain a cathode current density which is within the range of about 4 to 20 A/dm$^2$ (amps per square decimeter). Lower current densities can be utilized but the rate of electrodeposition will be too slow for utilization in most commercial operations. Higher current densities can also be used with the risk of burnt deposits resulting. It is normally preferred to maintain a current density which is within the range of about 8 to about 15 A/dm$^2$.

The electrodeposition procedure carried out in plating cell 10 results in $Cu^{2+}$ ions being reduced on the surface of the steel filament 11. This reaction can be depicted as:

$$Cu^{2+} + 2e = Cu$$

simultaneously, hydroxide ions are oxidized at the surface of the inert anode according to the reaction:

$$4\,OH^- \rightarrow O_2 + 2H_2O + 4e$$

as can be seen, oxygen gas and water are generated at the inert anode.

The steel filament will be provided with a sufficient amount of residence time in the pyrophosphate solution 14 of the plating cell to allow for the electrodeposition of a copper layer of the desired thickness. The thickness of the copper layer depends on the starting wire diameter and the final drawn filament diameter, but will typically be within the range of about 0.5 microns to about 5 microns. It will be more common for a copper layer having a thickness which is within the range of about 1 micron to about 2 microns to be applied. The thickness of the copper layer can be controlled by adjusting the residence time or current density of the steel filament in the copper pyrophosphate solution 14 in the plating cell. The rate of electrodeposition of copper onto the steel filament will also be dependent upon the concentration of copper ions in the copper pyrophosphate solution and the cathode current density. Both of these variables can also be adjusted to attain a desired result.

As the electrodeposition proceeds, the level of copper ion in the copper pyrophosphate solution 14 in the plating cell diminishes. This is, of course, because the copper ions are being reduced onto the negatively charged steel filament as a copper layer. It is accordingly necessary to replenish the level of copper ions in the copper pyrophosphate solution 14 in the plating cell. This is accomplished by exchanging, circulating or mixing the copper pyrophosphate solution 14 in the plating cell which has a reduced level of copper ions with copper ion replenished pyrophosphate solution 21 which is generated in replenishment cell 20. This can be accomplished by simply pumping replenished pyrophosphate solution 21 from the replenishment cell through tube or piping equipped with a pumping mechanism 22. The replenished pyrophosphate solution flows from the replenishment cell to the plating cell in the direction of arrow 23. A corresponding amount of copper pyrophosphate solution 14 is conveyed from the plating cell to the replenishment cell through pumping mechanism 34. The copper pyrophosphate solution flows from the plating cell to the replenishment cell in the direction of arrow 35. In some cases it will be possible to orient the plating cell and the replenishment cell in a manner where it is not necessary to utilize mechanical motion to pump the replenished copper pyrophosphate solution from the replenishment cell or the copper pyrophosphate solution from the plating cell to the replenishment cell because gravity will supply all of the force necessary to convey the solution. It should also be noted that the plating cell and replenishment cell do not need to be in separate tanks.

The replenished copper pyrophosphate solution 21 in the replenishment cell 20 is in contact with at least one copper anode having a positive charge. It is generally convenient to utilize copper nuggets 24 as the anode for the replenishment cell. However, the copper anode can be of any geometric shape such as chips, rods, plates, wires, or scrap pieces of varying shapes. The copper nuggets 24 can be held in a titanium basket 25 or some other device which will hold the copper nuggets and which is inert. The copper nuggets are oxidized at the anode according to the reaction:

$$Cu \rightarrow Cu^{2+} + 2e$$

This reaction increases the amount of copper ions present in the replenished copper pyrophosphate solution. The copper nuggets are consumed during the operation of the replenishment cell. It is accordingly necessary to add copper nuggets to the titanium basket 25 from time to time during the operation of the replenishment cell to maintain an adequate level of copper nuggets for proper operation. This is an easy task because it is only necessary to drop the copper nuggets 24 into the titanium basket 25.

The replenished copper pyrophosphate solution 21 in the replenishment cell 20 is in contact with a conductive membrane 26 of a copolymer of tetrafluoroethane and perfluoro-3,5-dioxa-4-methyl-7-octene sulfonic acid. The conductive membrane is comprised of fluoropolymer chains having perfluorinated cation exchange sites chemically bound thereto. Such conductive membranes are sold by E. I. DuPont de Nemours & Company as Nafion® perfluorinated membranes. Nafion® 300 and 400 series perfluorinated membranes have excellent characteristics for the conductive membrane. Nafion® 324, 417, 423, and 430 perfluorinated membranes are all effective with Nafion® 324 and 430 perfluorinated membranes being preferred. The Nafion® 324, 417, and 423 perfluorinated membranes should be soaked in hot water for about 30 minutes before being used as the conductive membrane in the replenishment cell. The Nafion® 430 perfluorinated membrane should be soaked in a 2% solution of sodium hydroxide at room temperature for about 8 hours prior to being used.

The conductive membrane allows for the flow of electrical current. However, the conductive membrane 26 does not allow for copper ions or pyrophosphate ions to flow through it. Thus, the conductive membrane 26 keeps copper ions from migrating through it and being deposited onto the cathode 27. The conductive membrane 26 separates the replenished copper pyrophosphate solution 21 from a potassium hydroxide solution 28 which is in contact with the negatively charged cathode 27. The negative charge is provided to the cathode and the positive charge is provided to the copper anode by a second direct current power source 36. The cathode 27 can be comprised of virtually any conductive material. For instance, steel can be used as the negatively charged cathode 27. Hydrogen gas is generated at the cathode 27 according to the reaction:

$$2H^{+} + 2e \rightarrow H_2$$

Even in commercial operations the amount of hydrogen generated is relatively small. Because only small amounts of hydrogen evolve, it can be allowed to simply escape into the atmosphere. However, it should be appreciated that hydrogen gas can be explosive and the use of open flame in the vicinity of the replenishment cell should be avoided.

As the replenishment cell operates, the concentration of hydroxide ions in the potassium hydroxide solution increases. Typically the potassium hydroxide concentration is not critical, but a concentration too low would increase the replenishment cell resistance and too high could cause membrane clogging and possible membrane degradation. The optimum range found is $50 \pm 5$ g/l of potassium hydroxide. Further potassium cation was chosen to maintain commonality with the cation in the pyrophosphate bath. It should also be noted that other solutions can be utilized in the replenishment cell. On the other hand, hydroxide ions are consumed in the plating cell at the inert anode. More specifically, hydroxide ions are converted to oxygen gas and water at the inert anode 15 in the plating cell. For this reason, potassium hydroxide solution is transported around the conductive membrane 26 in the replenishment cell to the replenished pyrophosphate solution 21 in an amount sufficient to replenish the hydroxide ion consumed at the inert anode 15 in the plating cell 10. This can be accomplished by simply pumping the potassium hydroxide solution 28 into the replenished copper phosphate solution 21 at the appropriate rate by potassium hydroxide solution pumping mechanism 29 in the direction of arrow 30. In an alternative embodiment of this invention, the potassium hydroxide solution could be pumped or transported by some other means directly into the copper pyrophosphate solution 14 in plating cell 10. It should be noted that potassium ions can diffuse through the conductive membrane 26 to reenter the potassium hydroxide solution 28.

Water is consumed as a consequence of operating the plating cell 10 and the replenishment cell 20. For this reason water is added to the potassium hydroxide solution in the replenishment cell. A sufficient amount of water is added to replace the potassium hydroxide solution which is transferred to the plating cell, the water which is reduced to hydroxide ions and hydrogen gas, and the water which evaporates from the plating cell and the replenishment cell. Water is added to maintain a relatively constant level of potassium hydroxide solution 28 in the replenishment cell. This can be accomplished by directly adding water from an external water supply 31 with the flow of water being controlled by valve 32 which is operated by a float 33.

The present invention will be described in more detail in the following examples. These examples are merely for the purpose of illustration and are not to be regarded as limiting the scope of the invention or the manner in which it may be practiced. Unless specifically indicated otherwise, all parts and percentages are given by weight.

EXAMPLE

In this experiment, a steel wire was plated with copper using the process of this invention. A Nafion ® 430 perfluorinated membrane was utilized as the conductive membrane in the replenishment cell. Copper nuggets were utilized as the copper anode in the replenishment cell.

The replenishment cell utilized a stainless steel cathode, an anode current density of less than $2A/dm^2$, a cathode current density of $1.4\ A/dm^2$ (assuming distribution over one face), a cathode voltage of $-1.3V$ versus a standard hydrogen electrode, a membrane current density of $12A/dm^2$, a cell current of 24A, and a cell voltage of 4.2V.

The copper pyrophosphate solution in the plating cell contained about 25 g/l of copper ions, contained about 185 g/l of pyrophosphate ions, had a ratio of copper ions to pyrophosphate ions of about 7.4, was maintained at a temperature of about 50° C., was maintained at a pH of about 8.5, and was agitated. The potassium hydroxide solution in the replenishment cell contained about 50 g/l of potassium hydroxide and was maintained at a temperature of about 50° C.

The plating cell utilized an iridium oxide coated titanium mesh anode (15 $g/m^2$ coating weight), an anode current density of $1A/dm^2$ (assuming distribution over one face), an anode voltage of 1.4V versus a standard hydrogen electrode, a cathode current density of $12A/dm^2$, a cell current of 26A, and a cell voltage of approximately 3.5V. Potassium hydroxide solution was transferred to the copper ion replenished copper pyrophosphate solution in the replenishment cell as needed to maintain the pH in the copper pyrophosphate solution in the plating cell and the potassium hydroxide concentration in the potassium hydroxide solution in the replenishment cell.

Steel wire was plated with copper to a thickness of $1\pm0.5$ microns using this procedure. This unit was operated for over 140 hours with excellent results being realized.

It should be noted that a cell voltage of at least one volt should be applied at all times during which an insoluble iridium oxide coated titanium anode is immersed in copper pyrophosphate solution. If such a voltage is not applied, there is a risk of dissolution of the titanium substrate. For the same reason such anodes should be rinsed after being removed from the copper pyrophosphate solution.

While certain representative embodiments and details have been shown for the purpose of illustrating the subject invention it will be apparent to those skilled in this art that various changes and modifications can be made therein without departing from the scope of the invention.

What is claimed is:

1. A process for applying a copper layer to a steel filament which comprises:

(a) applying a negative charge to the steel filament and continuously passing the steel filament through a plating cell wherein the negatively charged steel filament is in contact with an aqueous copper pyrophosphate solution and wherein the aqueous copper pyrophosphate solution is in contact with a positively charged inert anode:

(b) providing the negatively charged steel filament with sufficient residence time in the pyrophosphate solution to plate the steel filament with the copper layer of the desired thickness:

(c) replenishing the concentration of copper in the copper pyrophosphate solution in the plating cell by circulating the copper pyrophosphate solution in the plating cell with copper ion replenished copper pyrophosphate solution from a replenishment cell, wherein the replenished copper pyrophosphate solution in the replenishment cell is in contact with at least one copper anode having a positive charge, wherein the replenished copper pyrophosphate solution is in contact with a conductive membrane of a copolymer of tetrafluoroethylene and perfluoro-3,5-dioxa-4-methyl-7-octenesulfonic acid which separates the replenished copper pyrophosphate solution from a potassium hydroxide solution, wherein the potassium hydroxide solution is in contact with a negatively charged cathode:

(d) transferring a sufficient amount of the potassium hydroxide solution which is in contact with the negatively charged cathode which produces hydroxide ions to the copper pyrophosphate solution to replenish the hydroxide ions in the copper pyrophosphate solution which are consumed at the inert anode in the copper pyrophosphate solution in the plating cell: and (e) adding a sufficient amount of water to the potassium hydroxide solution to replace the potassium hydroxide transferred to the copper pyrophosphate solution and water lost through reduction and evaporation.

2. A process for applying a copper layer to a steel filament which comprises:

(a) applying a negative charge to the steel filament while it is in contact with an aqueous copper pyrophosphate solution, wherein the aqueous copper pyrophosphate solution is in contact with a positively charged inert anode:

(b) allowing copper ions from the aqueous copper pyrophosphate solution to be reduced on the surface of the steel filament to form the copper layer:

(c) replenishing the concentration of copper ions in the aqueous copper pyrophosphate solution by applying a positive charge to at least one copper anode which is in contact with the copper pyrophosphate solution and applying a negative charge to a cathode which is in contact with a potassium hydroxide solution, wherein the copper pyrophosphate solution and the potassium hydroxide solution are separated by a conductive membrane, wherein the conductive membrane allows electrical current to flow through it, wherein the conductive membrane allows potassium ions to diffuse through it, and wherein the conductive membrane prevents copper ions and pyrophosphate ions from diffusing through it.

3. A process as specified in claim..1 wherein the inert anode is an iridium oxide coated titanium electrode.

4. A process as specified in claim 1 wherein the inert anode is a platinized titanium electrode.

5. A process as specified in claim 1 wherein the copper pyrophosphate solution contains from about 22 to about 38 grams per liter of copper ions.

6. A process as specified in claim 5 wherein the copper pyrophosphate solution contains from about 159 to about 250 grams per liter of pyrophosphate ions.

7. A process as specified in claim 1 wherein the copper pyrophosphate solution is at a pH which is within the range of about 8 to about 9.3.

8. A process as specified in claim 1 wherein the copper pyrophosphate solution is maintained at a temperature which is within the range of about 45° C. to about 55° C.

9. A process as specified in claim 1 wherein a cathode current density which is within-the range of about 8 to about 15 $A/dm^2$ is maintained on the cathode which is in contact with the copper pyrophosphate solution.

10. A process as specified in claim 1 wherein copper nuggets are utilized as the copper anode.

11. A process as specified in claim 1 wherein the potassium hydroxide solution contains from about 45 to about 55 g/l of potassium hydroxide.

12. A process as specified in claim 1 wherein the potassium hydroxide solution is maintained at a temperature which is within the range of 48° C. to 52° C.

13. A process as specified in claim 1 wherein the copper pyrophosphate solution is maintained at a temperature which is within the range of 48° C. to 52° C.

14. A process as specified in claim 2 wherein the conductive membrane is a perfluorinated membrane.

15. A process as specified in claim 2 wherein the conductive membrane is comprised of a copolymer of tetrafluoroethane and perfluoro-3,5-dioxa-4-methyl-7-octene sulfonic acid.

* * * * *